US005874193A

United States Patent [19]

Liu et al.

[11] Patent Number: 5,874,193

[45] Date of Patent: Feb. 23, 1999

[54] PHOTOCONDUCTIVE IMAGING MEMBERS

[75] Inventors: Ping Liu, Mississauga; Nan-Xing Hu, Oakville; H. Bruce Goodbrand, Hamilton; Cheng-Kuo Hsiao; Beng S. Ong, both of Mississauga, all of Canada

[73] Assignee: Xerox Corporation, Stamford, Conn.

[21] Appl. No.: 124,789

[22] Filed: Jul. 30, 1998

[51] Int. Cl.[6] ..... G03G 5/047; G03G 5/14

[52] U.S. Cl. ..... 430/59; 430/58; 430/64

[58] Field of Search ..... 430/58, 59, 64

[56] References Cited

U.S. PATENT DOCUMENTS

| | | | |
|---|---|---|---|
| 4,265,990 | 5/1981 | Stolka et al. | 430/59 |
| 4,298,697 | 11/1981 | Baczek | 521/27 |
| 4,338,390 | 7/1982 | Lu | 430/106 |
| 4,464,450 | 8/1984 | Teuscher | 430/59 |
| 4,555,463 | 11/1985 | Hor et al. | 430/59 |
| 4,560,635 | 12/1985 | Hoffend et al. | 430/106.6 |
| 4,584,253 | 4/1986 | Lin et al. | 430/59 |
| 4,587,189 | 5/1986 | Hor et al. | 430/59 |
| 4,921,769 | 5/1990 | Yu et al. | 430/132 |
| 4,921,773 | 5/1990 | Melnyk et al. | 430/132 |
| 4,988,597 | 1/1991 | Spiewak et al. | 430/64 |
| 5,378,566 | 1/1995 | Yu | 430/58 |
| 5,385,796 | 1/1995 | Spiewak et al. | 430/64 |
| 5,460,911 | 10/1995 | Yu et al. | 430/64 |
| 5,660,961 | 8/1997 | Yu | 430/58 |

*Primary Examiner*—Roland Martin
*Attorney, Agent, or Firm*—E. O. Palazo

[57] ABSTRACT

A photoconductive imaging member comprised of a supporting substrate, a hole blocking layer thereover, a photogenerating layer and a charge transport layer, and wherein the hole blocking layer is comprised of a crosslinked siloxane polymer schematically represented by wherein A, B, and C are the repeating units on the polymer backbone; D and E are divalent linkages; R' and P" are selected from the group consisting of hydrogen, fluorine, chlorine, bromine, iodine, cyano, nitro, alkyl, alkoxy, acyl, alkoxycarbonyl, and aryloxycarbonyl; and x, y, and z are the molar fractions of the repeating monomer units such that the sum of x+y+z equal to about 1.

35 Claims, 1 Drawing Sheet

PHOTOCONDUCTIVE IMAGING MEMBERS

COPENDING APPLICATION

In copending application U.S. Ser. No. 09/124,717 pending, filed concurrently herewith, and the disclosure of which is totally incorporated herein by reference, relates to A photoconductive imaging member comprised of a supporting substrate, a hole blocking layer thereover, a photogenerating layer and a charge transport layer, and wherein the hole blocking layer is comprised of a crosslinked polymer of the formula

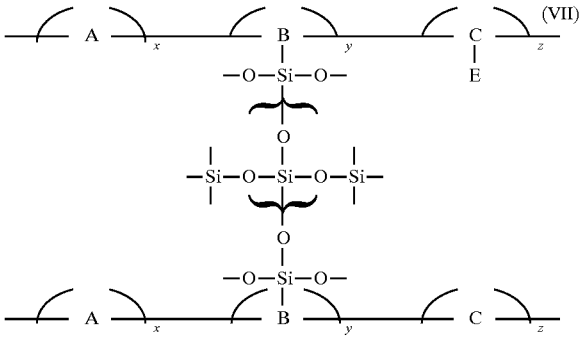

wherein E is an electron transport moiety; A, B, and C represent the segments of the polymer backbone containing appropriate divalent linkages; and x, y, and z are mole fractions of the repeating monomer units wherein x+y+z is equal to about 1.

BACKGROUND OF THE INVENTION

This invention is generally directed to imaging members, and, more specifically, the present invention is directed to improved multilayered imaging members with a hole blocking layer preferably situated in between the supporting substrate and the photogenerating layer, and which layer is comprised of a crosslinked siloxane polymer wherein an electron transporting moiety represented by Formula (I) has been covalently bonded as a pendant segment to the polymer backbone:

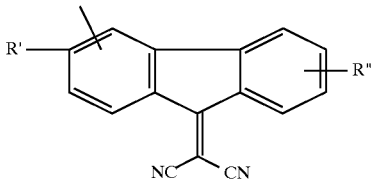

where R' and R" are substituents independently selected from the group consisting of hydrogen, halogen, alkyl, alkoxy, alkoxycarbonyl, acyl, cyano, nitro, and the like. The primary function of the hole blocking layer is to prevent dark injection of holes from the supporting substrate into the photogenerating layer, thereby eliminating or minimizing high dark decay and/or charge deficient spot problems.

The imaging members of the present invention in embodiments exhibit excellent electrical properties, cyclic and environmental stability, and substantially no adverse changes in performance over extended time periods. Processes of imaging, especially xerographic imaging and printing, including digital, are also encompassed by the present invention. More specifically, the layered photoconductive imaging members can be selected for a number of different known imaging and printing processes including, for example, electrophotographic imaging processes, especially xerographic imaging and printing processes wherein negatively charged images are rendered visible with toner compositions of an appropriate charge polarity. Moreover, the imaging members of this invention are preferably useful in color xerographic applications where several color printings can be achieved in a single pass. The imaging members as indicated herein are in embodiments sensitive in the wavelength region of, for example, from about 450 to about 900 nanometers, and in particular, from about 700 to about 850 nanometers, thus diode lasers can be selected as the light source.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

The use of certain perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyldiimide dual layered negatively charged photoreceptors with improved spectral response in the wavelength region of 400 to 700 nanometers. A similar disclosure is revealed in Ernst Gunther Schlosser, *Journal of Applied Photographic Engineering*, Vol. 4, No. 3, page 118 (1978). There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Also, there are specifically disclosed in this patent dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport can be selected for the imaging members of the present invention.

In U.S. Pat. No. 4,921,769, the disclosure of which is totally incorporated herein by reference there is illustrated photoconductive imaging members with blocking layers of certain polyurethanes. However, since the polyurethanes possess a certain degree of solubility in many organic solvents, the use of them as the charge blocking layers may limit the choice of solvents for the next layer coated thereover, such as the adhesive layer or the photogenerator layer, during the fabrication of photoresponsive devices. Advantages of the hole blocking layer of the present invention over that of the '769 patent, especially where the blocking layer is comprised of a crosslinked polymer composition containing a covalently bonded electron transporting moiety illustrated herein, include excellent resistance to solvent degradation, superior electron transport, and excellent electrical properties, and cyclic and environmental stability.

FIGURES

Illustrated in FIGS. 1 and 2 are photoconductive imaging members of the present invention.

SUMMARY OF THE INVENTION

It is a feature of the present invention to provide imaging members thereof with many of the advantages illustrated herein.

Another feature of the present invention relates to the provision of improved layered photoresponsive imaging members which are photosensitive in the near infrared radiation region.

It is yet another feature of the present invention to provide improved layered photoresponsive imaging members with a sensitivity to visible light, and which members possess improved electrical properties and enhanced cyclic/environmental stability.

Moreover, another feature of the present invention relates to the provision of layered photoresponsive imaging members with solvent resistant and durable crosslinked polymer hole blocking layers.

Aspects of the present invention relate to a photoconductive imaging member comprised of a supporting substrate, a hole blocking layer thereover, a photogenerating layer and a charge transport layer, and wherein the hole blocking layer is comprised of a crosslinked siloxane polymer schematically represented by

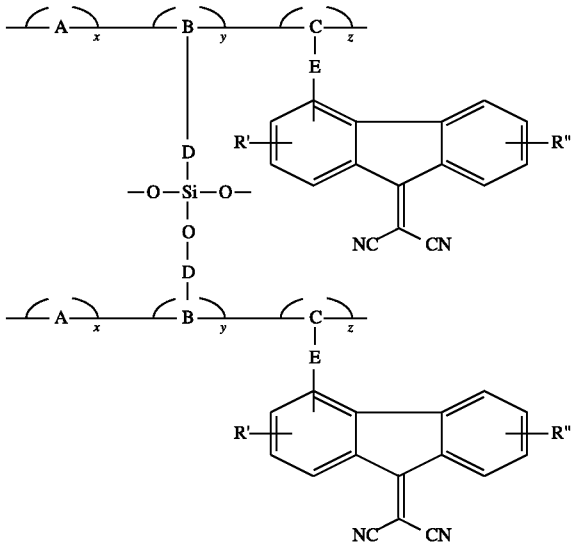

wherein A, B, and C are the repeating units on the polymer backbone; D and E are divalent linkages; R' and R" are selected from the group consisting of hydrogen, fluorine, chlorine, bromine, iodine, cyano, nitro, alkyl, alkoxy, acyl, alkoxycarbonyl, and aryloxycarbonyl; and x, y, and z are the molar fractions of the repeating monomer units such that the sum of x+y+z equal to about 1; a photoconductive imaging member wherein D is selected from suitable divalent linkages of alkylene, arylene, alkyleneoxycarbonyl, or aryleneoxycarbonyl; and E is selected from divalent linkages of arylene, alkylenearyl, alkyleneoxycarbonyl, aryleneoxycarbonyl, carbonyloxyalkeneoxycarbonyl, carbonyloxyaryieneoxy carbonyl, carbonyloxyalkylenearyl, carbonyloxyaryl, carbonyloxylalkylene aminocarbonyl, carbonyloxylarylene aminocarbonyl; a photoconductive imaging member wherein D is alkyleneoxycarbonyl of dimethyleneoxycarbonyl, or trimethyleneoxycarbonyl, or aryleneoxycarbonyl of phenyleneoxycarbonyl, or methylenearyloxycarbonyl; E is carbonyloxyalkeneoxycarbonyl, carbonyloxyaryleneoxycarbonyl, carbonyloxyalkylenearyl, or carbonyloxyaryl, and X is alkoxy containing from about 1 to about 6 carbon atoms; a photoconductive imaging member wherein A is derived from a vinyl monomer selected from the group consisting of styrene, substituted styrene, acrylonitrile, 1,3-diene, vinyl halide, acrylate, or methacrylate; a photoconductive imaging member wherein acrylate is selected from the group consisting of methyl acrylate, ethyl acrylate, propyl acrylate, and butyl acrylate; and methacrylate is selected from the group consisting of methyl methacrylate, ethyl methacrylate, propyl methacrylate, and butyl methacrylate; a photoconductive imaging member wherein x ranges from about 0 (zero) to about 0.95, y ranges from about 0.01 to about 0.50, and z ranges from about 0.01 to about 0.50; a photoconductive imaging member comprised of a supporting substrate, a hole blocking layer thereover, a photogenerating layer and a charge transport layer, and wherein the hole blocking layer is comprised of a crosslinked siloxane polymer derived from the hydrolysis and condensation of polymer (III)

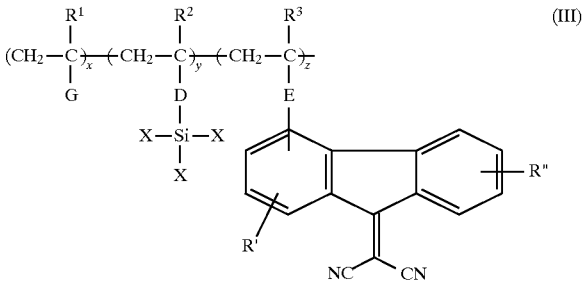

wherein $R^1$, $R^2$, and $R^3$ are hydrogen atoms or alkyl groups; G is chlorine, cyano, aryl, alkoxycarbonyl, or aryloxycarbonyl; D is selected from the group consisting of arylene, alkylenearyl, alkyleneoxyaryl, alkyleneoxycarbonyl, and aryleneoxycarbonyl; E is selected from the group consisting of arylene, alkylenearyl, alkyleneoxycarbonyl, aryleneoxycarbonyl, carbonyloxyalkeneoxycarbonyl, carbonyloxyaryleneoxycarbonyl, carbonyloxyalkylenearyl, carbonyloxyaryl, carbonyloxyalkyleneamino carbonyl, and carbonyoxylarylene aminocarbonyl; X is a hydrolyzable function selected from the group consisting of chlorine, bromine, iodine, amino, alkoxy and acyloxy, and aryloxy; R' and R" are substituents selected from the group consisting of hydrogen, fluorine, chlorine, bromine, iodine, cyano, nitro, alkyl, alkoxy, acyl, alkoxycarbonyl, and aryloxycarbonyl; x, y, and z are the molar fractions of the repeating monomer units such that x+y+z is equal to about 1; a photoconductive imaging member wherein D is alkyleneoxycarbonyl or aryleneoxycarbonyl; E is carbonyloxyalkeneoxycarbonyl, carbonyloxyaryleneoxycarbonyl, carbonyloxyaryl, or carbonyloxyalkylenearyl; X is alkoxy containing from about 1 to about 3 carbon atoms; G is alkoxycarbonyl, chlorine, or cyano; and R' and R" are independently selected from hydrogen and alkyl containing from about 1 to about 10 carbon atoms; a photoconductive imaging member wherein x ranges from about 0 to about 0.95, y ranges from about 0.01 to about 0.50, and z ranges from about 0.01 to about 0.50; a photoconductive imaging member wherein $R^1$, $R^2$, and $R^3$ are hydrogen atoms or methyl groups; a photoconductive imaging member wherein E is selected from the group consisting of formulas (IV) through (VI)

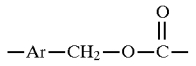

(IV)

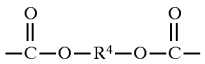

(V)

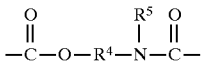

(VI)

wherein Ar is arylene containing from about 6 to about 10 carbon atoms; $R^4$ is alkylene containing from about 1 to about 10 carbon atoms, or arylene containing from about 6 to about 12 carbon atoms, and $R^5$ is hydrogen or alkyl containing from about 1 to about 3 carbon atoms; a photoconductive imaging member wherein polymer (III) has an $M_n$ of about 2,000 to about 50,000; a photoconductive imaging member wherein polymer (III) is selected from the group consisting of Formulas (II-a) through (III-h); a photoconductive imaging member wherein (III-a), (III-b), or (III-c) is selected; a photoconductive imaging member wherein the thickness of the hole blocking layer ranges from about 0.01 to about 5 microns; a photoconductive imaging member wherein the supporting substrate is comprised of a metal; a photoconductive imaging member wherein the conductive substrate is aluminum, aluminized MYLAR®, or titanized MYLAR®; a photoconductive imaging member wherein the photogenerator layer is of a thickness of from about 0.05 to about 5 microns; a photoconductive imaging member wherein the transport layer is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layer is comprised of an arylamine dispersed in a resinous binder such as polystyrene, polyester or polycarbonate; a photoconductive imaging member wherein the arylamine is represented by the following formula

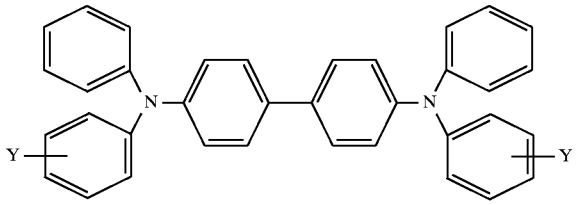

wherein Y is selected from the group consisting of alkyl and halogen atoms; a photoconductive imaging member wherein alkyl contains from about 1 to about 25 carbon atoms; a photoconductive imaging member wherein alkyl contains from 1 to about 5 carbon atoms; a photoconductive imaging member wherein the arylamine is N,N'-diphenyl-N,N-bis(3-methyl phenyl)1,1'-biphenyl-4,4'-diamine; a photoconductive imaging member further including an adhesive layer; a photoconductive imaging wherein the photogenerating layer is comprised of metal phthalocyanines, perylenes or metal free phthalocyanines; a photoconductive imaging member wherein titanyl phthalocyanine, perylenes, or hydroxygallium phthalocyanine is selected as the photogenerating pigment; a photoconductive imaging member wherein the photogenerating layer is comprised of Type V hydroxygallium phthalocyanine dispersed in a polymer binder; a method of imaging which comprises generating an electrostatic latent image on the imaging member, developing the latent image, and transferring the developed electrostatic image to a suitable substrate; a member wherein the crosslinked siloxane polymer is

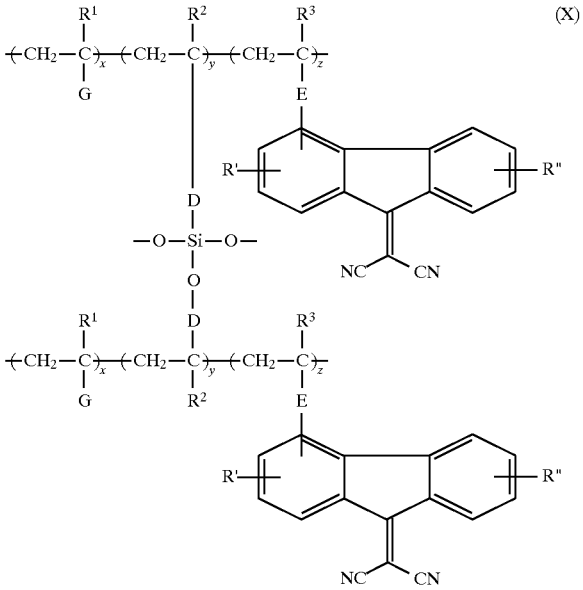

(X)

wherein $R^1$, $R^2$, and $R^3$ are hydrogen atoms or alkyl groups; G is chlorine, cyano, aryl, alkoxycarbonyl, or aryloxycarbonyl; D is a divalent linkage selected from the group consisting of arylene, alkylenearyl, alkyleneoxyaryl, alkyleneoxycarbonyl, and aryleneoxycarbonyl; E is a divalent linkage selected from the group consisting of arylene, alkylenearyl, alkyleneoxycarbonyl, aryleneoxycarbonyl, carbonyloxyalkeneoxycarbonyl, carbonyloxyaryleneoxycarbonyl, carbonyloxyalkylenearyl, carbonyloxyaryl, carbonyloxylalkyleneaminocarbonyl, and carbonyoxylarylene aminocarbonyl; R' and R" are substituents selected from the group consisting of hydrogen, fluorine, chlorine, bromine, iodine, cyano, nitro, alkyl, alkoxy, acyl, alkoxycarbonyl, or aryloxycarbonyl; x, y, and z are the molar fractions of the repeating monomer units such that x+y+z is equal to about 1; a member wherein said crosslinked siloxane polymer is derived from the hydrolysis and condensation of polymer (II)

(II)

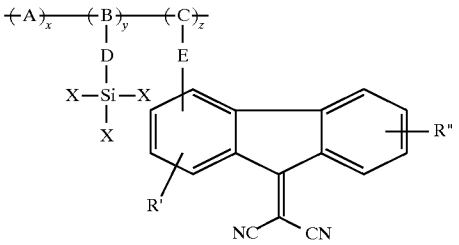

wherein X is a hydrolyzable function; the polymer schematically represented by

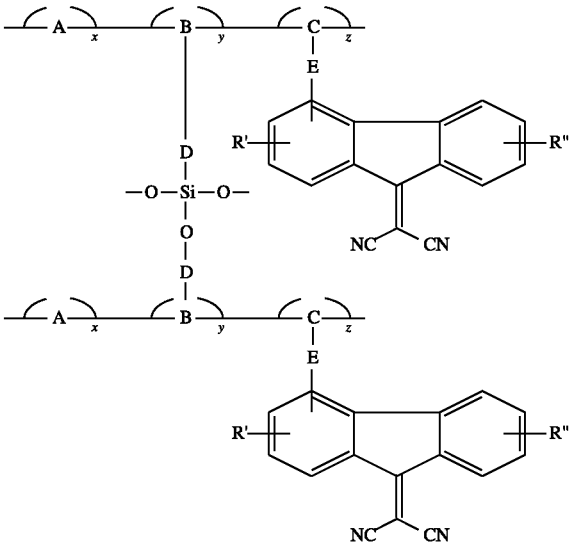

wherein A, B, and C are the repeating units on the polymer backbone; D and E are divalent linkages; R' and R" are selected from the group consisting of hydrogen, fluorine, chlorine, bromine, iodine, cyano, nitro, alkyl, alkoxy, acyl, alkoxycarbonyl, and aryloxycarbonyl; and x, y, and z are the molar fractions of the repeating monomer units such that the sum of x+y+z equal to about 1;

a polymer generated by the polymerization of (III-a)

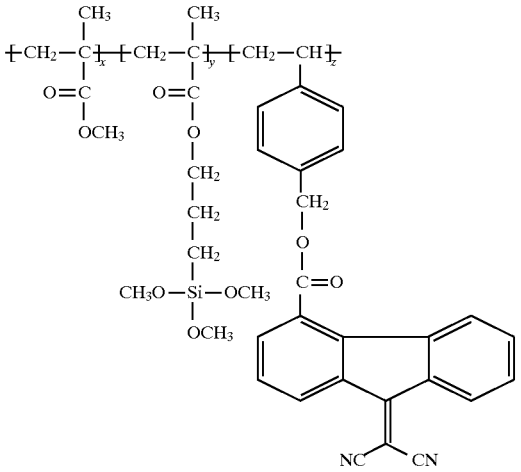

-continued (III-b)

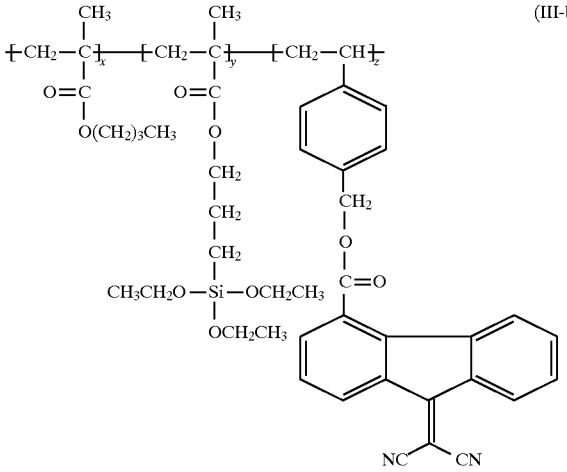

(III-c)

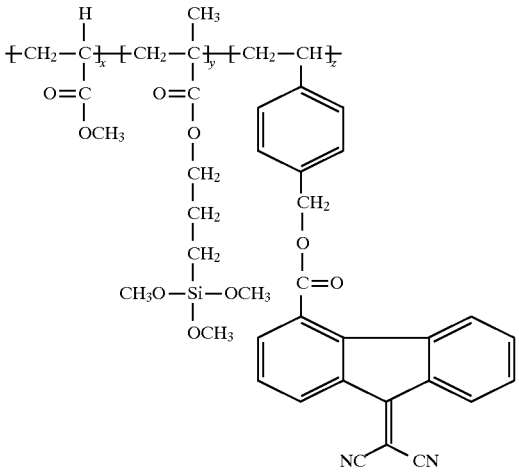

(III-d)

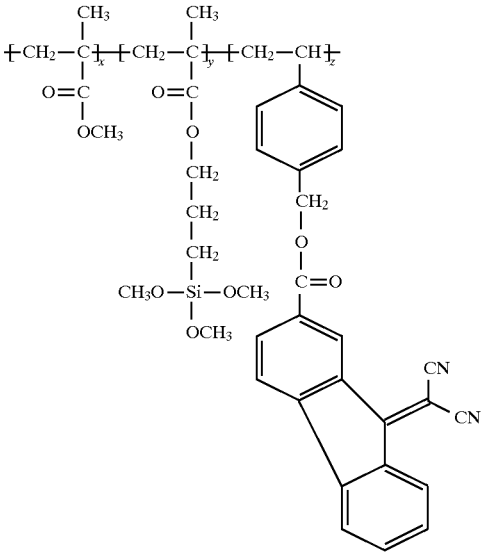

-continued
(III-e)
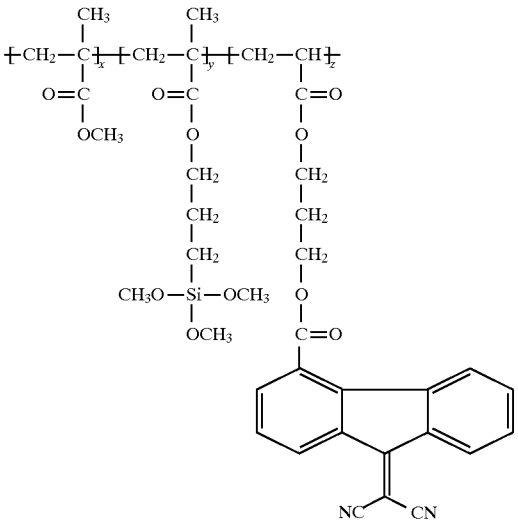
(III-f)
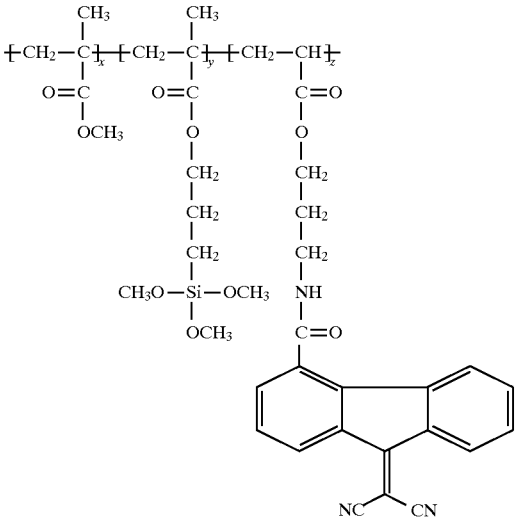
(III-g)
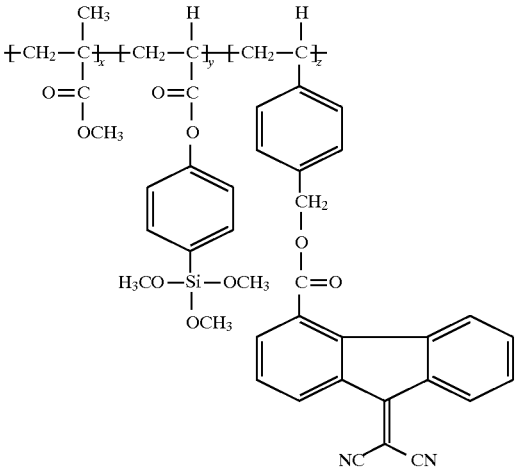
-continued
(III-h)
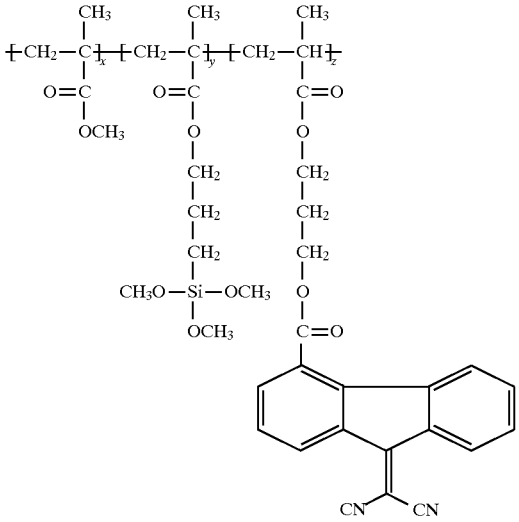
a member wherein said crosslinked siloxane is generated by the polymerization of
(III-a)
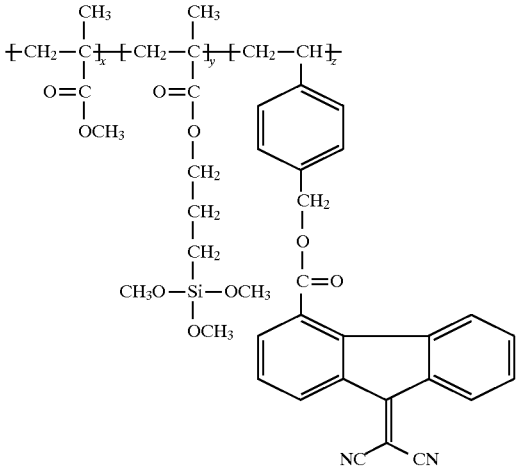
(III-b)
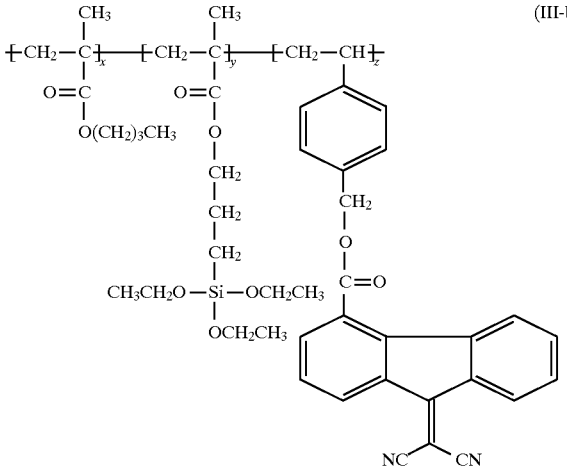

-continued
(III-c)
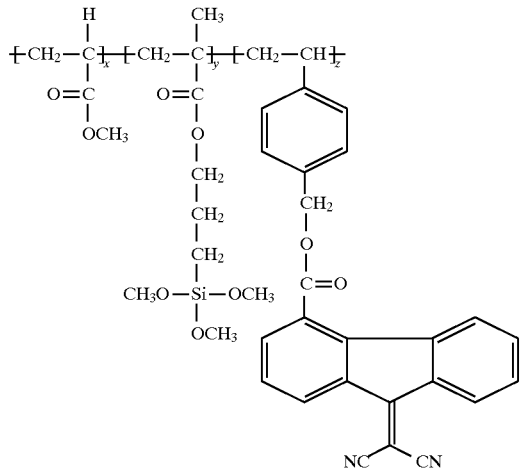
(III-d)
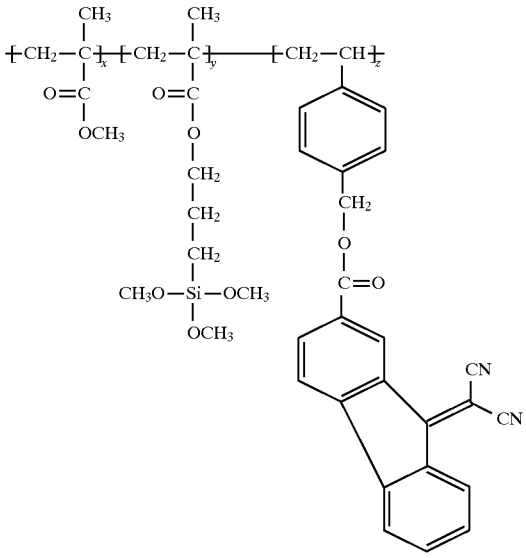
(III-e)
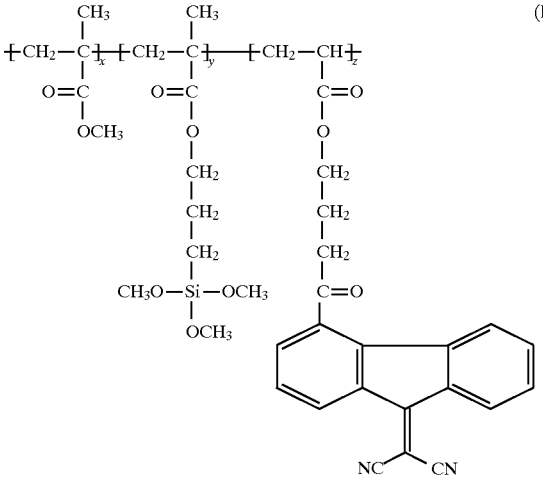
-continued
(III-f)
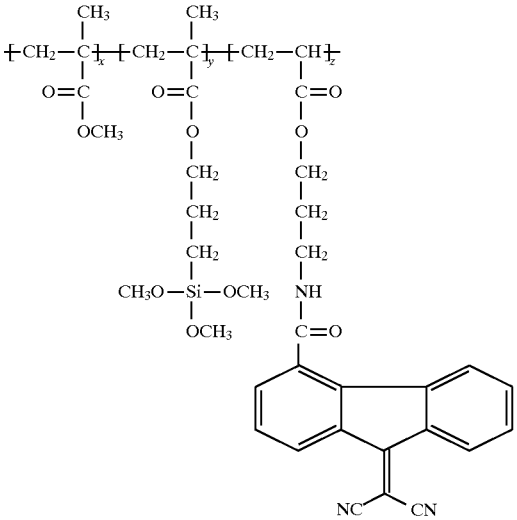
(III-g)
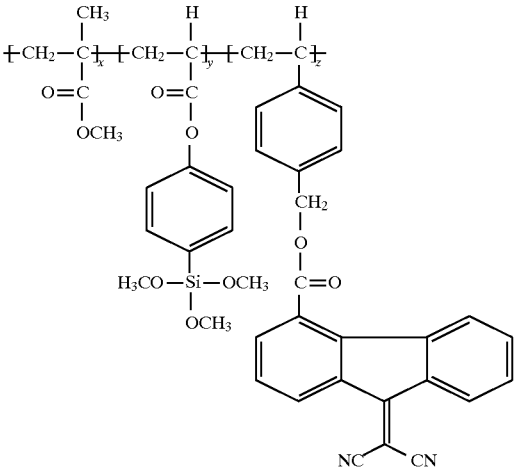
(III-h)
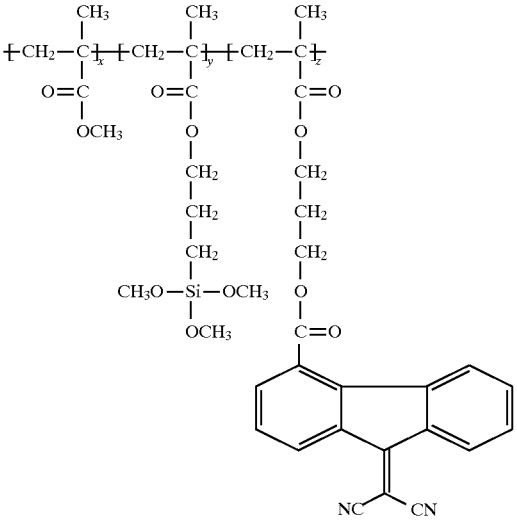
a photoconductive imaging member wherein x is a number of from about 0.5 to about 0.75, y is a number of from about 0.05 to about 0.25, and z is a number of from about 0.01 to about 0.50, subject to the provision that the sum of x+y+z is equal to about 1; a photoconductive imaging member wherein x is a number of from about 0.3 to about 0.65, y is a number of from about 0.1 to about 0.50, and z is a number of from about 0.1 to about 0.50, and wherein the sum of x+y+z is equal to about 1; and imaging members with a crosslinked hole blocking layer that is resistant to solvent attack, or solvent degradation from the photogenerator coating dispersion, and is therefore substantially immune to the disturbance caused by subsequent coating of the photogenerator layer. More specifically, the photoconductive imaging members of the present invention are comprised of a supporting substrate coated with a ground plane layer, a crosslinked siloxane hole blocking layer thereover, a photogenerating layer of, for example, hydroxygallium phthalocyanine, and a charge transport layer, and wherein the hole blocking layer contains a covalently bonded electron transport moiety as represented by (I).

The hole blocking layer can be prepared by applying a solution of an alkoxysilyl-functionalized polymer with for example, an $M_n$ of about 2,000 to about 50,000, or preferably an $M_n$ of from about 5,000 to about 40,000, and bearing an electron transport moiety (I) onto a supporting substrate to form a blocking layer after drying and curing, or heating at a temperature ranging from about 50° C. to about 200° C., and preferably from about 80° C. to about 150° C. for a duration of for example, about 30 minutes to about 2 hours, and wherein the hole blocking layer has a thickness ranging from, for example, about 0.01 to about 10 microns and preferably from about 0.05 to about 5 microns. For more rapid curing of the polymer layer, a curing catalyst such as amine or acid can be added to accelerate the crosslinking reactions.

In embodiments the imaging members of the present invention exhibit excellent electrical properties, such as low dark decay, fast discharge, and low residual potential, and excellent cyclic and environmental stability, such as for example over 50,000 cycles in various environmental conditions of high, such as about 80 percent, and low, such as about 25 percent, relative humidity at a temperature range of, for example, from about 10° C. to about 50° C.

DESCRIPTION OF THE PREFERRED EMBODIMENTS

Figure 1:
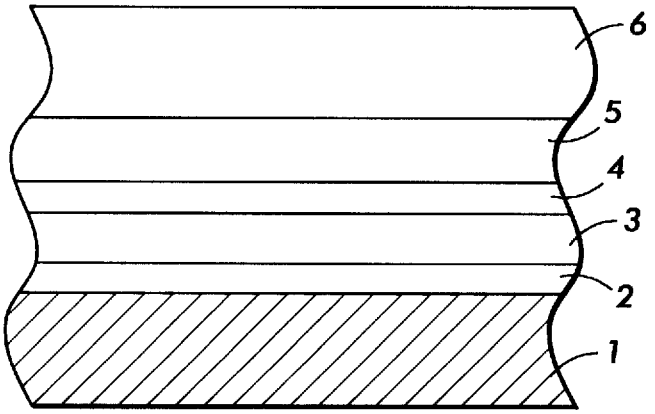

The preferred hole blocking layer of the present invention is comprised of a crosslinked siloxane polymer derived from the crosslinking or curing of the polymer represented by Formula (II)

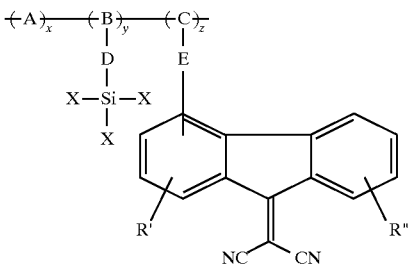

wherein A, B, and C are the repeating units on the polymer backbone; D is preferably selected from suitable divalent linkages such as alkylenearyl and arylene containing, for example, from about 6 to about 30, and preferably from about 6 to about 18 carbon atoms including for example phenylene, tolylene, methylenephenyl, dimethylenephenyl, trimethylenephenyl, and the like, alkyleneoxycarbonyl containing, for example, from about 2 to about 20, and preferably from about 3 to about 10 carbon atoms including, for example, dimethyleneoxycarbonyl, trimethyleneoxycarbonyl and the like, aryleneoxycarbonyl containing, for example, from about 7 to about 30, and preferably from about 7 to about 16 carbon atoms, including, for example, phenyleneoxycarbonyl, methylenephenoxycarbonyl, and the like; E is preferably selected from suitable divalent linkages such as for example arylene of for example, about 6 to about 30, and preferably from about 6 to about 18 carbon atoms, alkylenearyl of, for example, about 7 to about 30 carbon atoms, alkyleneoxycarbonyl of, for example, about 2 to about 20 carbon atoms, aryleneoxycarbonyl of, for example, about 7 to about 30 carbon atoms, carbonyloxyalkeneoxycarbonyl of, for example, about 3 to about 20 carbon atoms, carbonyloxyaryleneoxycarbonyl of for example about 8 to about 30 carbon atoms, carbonyloxyalkylenearyl of, for example, about 8 to about 30 carbon atoms, carbonyloxyaryl of for example about 7 to about 20 carbon atoms, carbonyloxylalkylene aminocarbonyl of, for example, about 3 to about 30 carbon atoms, carbonyoxylarylene aminocarbonyl of, for example, about 8 to about 30 carbon atoms, and the like; X is a hydrolyzable function selected, for example, from the group consisting of chlorine, bromine, iodine, amino, alkoxy containing from about 1 to about 12 carbon atoms, acyloxy containing from about 1 to about 12 carbon atoms, and the like; x, y, and z represent the molar fractions of the repeating monomer units, and wherein, for example, x ranges from about 0 to about 0.95, y ranges from about 0.01 to about 0.50, and z ranges from about 0.01 to about 0.50, and subject to the provision that that x+y+z=1, and R and R" are as illustrated herein, such as hydrogen, alkyl, alkoxy, and the like.

More specifically, the preferred polymer for the preparation of the blocking layer of the present invention is represented by polymer (III)

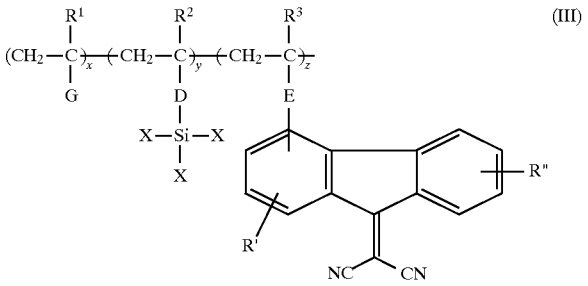

wherein $R^1$, $R^2$, and $R^3$ are hydrogen atoms or aliphatic groups, such as alkyl groups with for example, from about 1 to about 12, and preferably about 5 carbon atoms; R' and R" are substituents selected, for example, from the group consisting of hydrogen, fluorine (fluoride), chlorine, bromine, iodine, cyano, nitro, alkyl, acyl, alkoxy, alkoxycarbonyl, aryloxycarbonyl, and the like; G is halogen, such as chloride, cyano, aryl, alkoxycarbonyl, aryloxycarbonyl and the like, wherein alkoxy contains, for example, from about 1 to about 10 carbon atoms and aryloxy contains, for example, from about 6 to about 20 carbon atoms; X is a hydrolyzable function selected, for example, from the group consisting of chlorine, bromine, iodine, amino, alkoxy containing, preferably for example, from about 1 to about 5 carbon atoms, acyloxy containing, for example, from about 1 to about 5 carbon atoms, and the like; x, y, and z represent the molar fractions of the repeating monomer units, and wherein x is from about 0 to about 0.95, y is from about 0.01 to about 0.50, and z is from about 0.01 to about 0.50, and wherein the sum of x+y+z is equal to about 1; D is a divalent linkage selected, for example, from the group consisting of arylene, alkylenearyl, alkyleneoxycarbonyl, aryleneoxycarbonyl, and the like; E is a divalent linkage selected, for example, from the group consisting of Formulas (IV) through (VI) and the like:

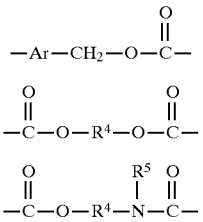

(IV)

(V)

(VI)

wherein Ar is an arylene group containing from about 6 to about 18 carbon atoms; $R^4$ is an alkylene group containing from about 1 to about 10 carbon atoms, or an arylene group containing from about 6 to about 24 carbon atoms; and $R^5$ is hydrogen atom or an alkyl group containing from about 1 to about 10 carbon atoms. The number average molecular weight, $M_n$ of the polymer (III) ranges, for example, from about 2,000 to 50,000, and preferably from about 5,000 about 30,000.

In embodiments of the present invention, polymer (II) and (III) preferably has the following structural moieties and substituents: $R^1$, $R^2$, and $R^3$ are independently selected from a hydrogen atom and methyl; G is styrene, substituted styrene, or an alkoxycarbonyl wherein the alkoxy is preferably methoxy, ethoxy, propoxy, or butoxy; X is acyloxy or alkoxy containing from about 1 to about 3 carbon atoms; D is alkyleneoxycarbonyl with its alkylene being containing from about 1 to about 10 carbon atoms; E is selected from the group consisting of Formulas (IV) through (VI), wherein Ar is an arylene containing from about 6 to about 10 carbon atoms, $R^4$ is an alkylene containing from about 1 to about 6 carbon atoms, and $R^5$ is hydrogen atom or an alkyl containing from about 1 to about 3 carbon atoms.

Polymer (III) of the present invention can be prepared by free radical polymerization according to Scheme 1. Specifically, this polymer can be prepared by the polymerization with heating of a mixture of vinyl monomers (VII), (VIII) and (IX) in the presence of a suitable radical initiator such as benzoyl peroxide, 2,2'-azobis(2-methylpropanenitrile), and the like. The polymerization is generally accomplished in an inert solvent such as benzene, toluene, tetrahydrofuran, chloroform, or the like, at a temperature of between about 40° C. to about 120° C.

Scheme 1

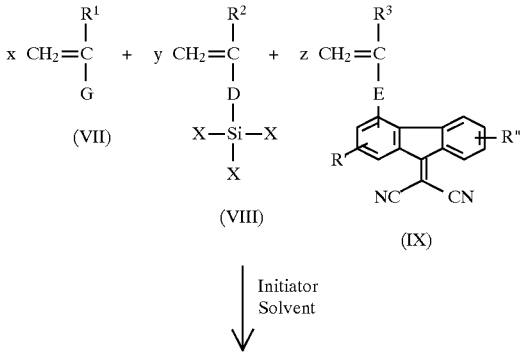

-continued

Scheme 1

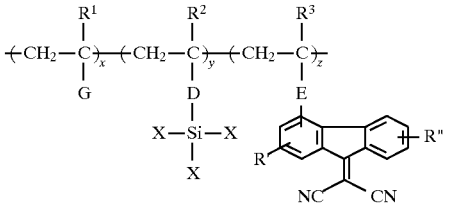

(III)

wherein $R^1$, $R^2$, $R^3$, G, X, R' and R", D and E are as illustrated herein.

Illustrative examples of monomer (VII) selected for the preparation of polymer (III) include acrylic and methacrylic esters such as methyl acrylate, ethyl acrylate, propyl acrylate, butyl acrylate, methyl methacrylate, ethyl methacrylate, propyl methacrylate, butyl methacrylate, phenyl acrylate, phenyl methacrylate, and the like. Illustrative examples of monomer (VIII) include 3-acryloxypropyl trimethoxysilane, 3-methacyloxypropyl trimethoxysilane, 3-acryloxypropyl triethoxysilane, 3-methacyloxypropyl triethoxysilane, 3-acryloxyethyl trimethoxysilane, 3-methacyloxyethyl trimethoxysilane, 3-methacryloxypropyl-dimethylethoxysilane, allyltrimethoxysilane, allyltriethoxysilane, and the like. Illustrative examples of vinyl monomer (IX) include p-vinylbenzyl 9-dicyanomethylenefluorene-4-carboxylate (1); p-isopropenylbenzyl 9-dicyanomethylenefluorene-4-carboxylate (2); p-vinylbenzyl 9-dicyanomethylenefluorene-2-carboxylate (3); methacryloyloxyethyl 9-dicyanomethylenefluorene-4-carboxylate (4); acryloyloxyethyl 9-dicyanomethylenefluorene-4-carboxylate (5); methacryloyloxyethyl 9-dicyanomethylenefluorene-2-carboxylate (6); acryloyloxyethyl 9-dicyanomethylenefluorene-2-carboxylate (7); methacryloyloxypropyl 9-dicyanomethylenefluorene-4-carboxylate (8); and the like.

(1)

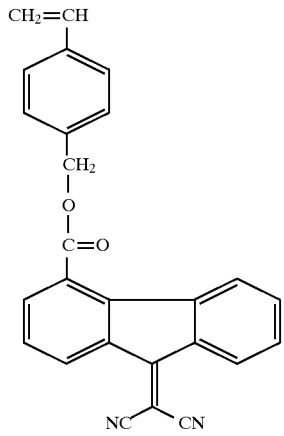

-continued
(2)
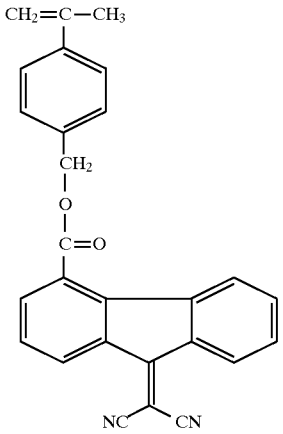
(3)
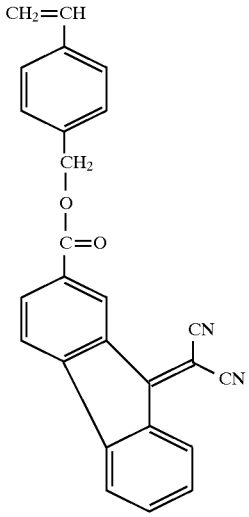
(4)
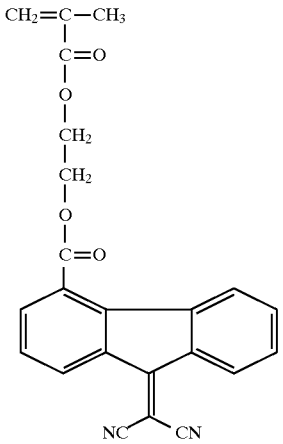
-continued
(5)
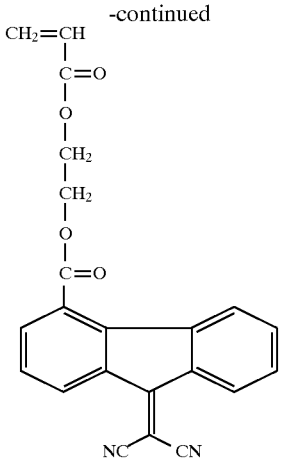
(6)
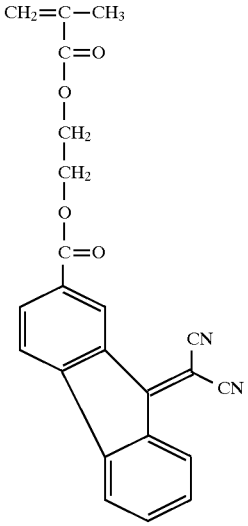
(7)
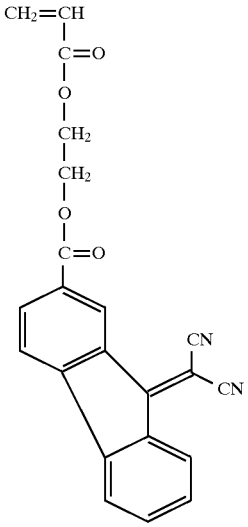

-continued

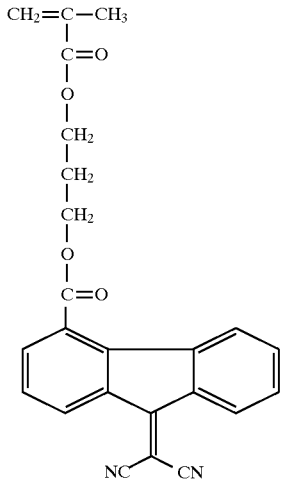

(8)

Specifically, the preparation of polymer (III) is illustrated by the following procedure. A mixture of monomers (VII), (VIII), and (IX) in effective molar equivalent amounts, such as 1:1:1, and a solvent, such as toluene, are first charged to a reactor. The mixture is stirred at a temperature ranging from ambient to about 70° C. for about 5 to about 30 minutes. Subsequently, an initiator such as benzoyl peroxide is added and the mixture is heated at about 50° C. to about 100° C. for about 5 to about 24 hours to complete the polymerization. After the polymerization, the reaction mixture is diluted with a solvent such as toluene, and poured into hexane to precipitate the polymer product, and which product is collected by filtration and dried in vacuo to provide polymer (III), which is characterized by gel permeation chromatography (GPC), and other relevant spectroscopic techniques such as IR and NMR spectroscopy.

Illustrative polymers (III) which are useful for the fabrication of hole blocking layers of the photoresponsive imaging members of the present invention are represented by (III-a) through (III-h):

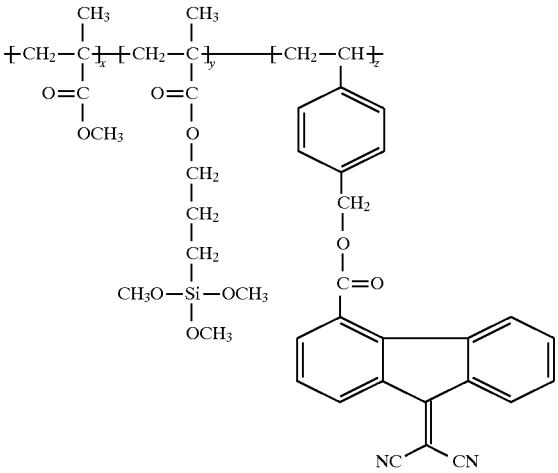

(III-a)

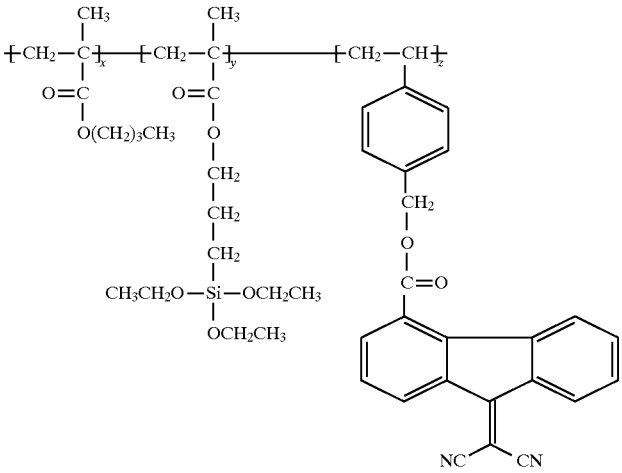

(III-b)

-continued
(III-c)
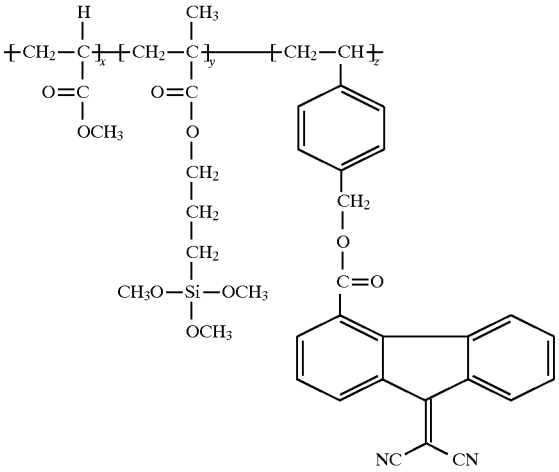
(IIII-d)
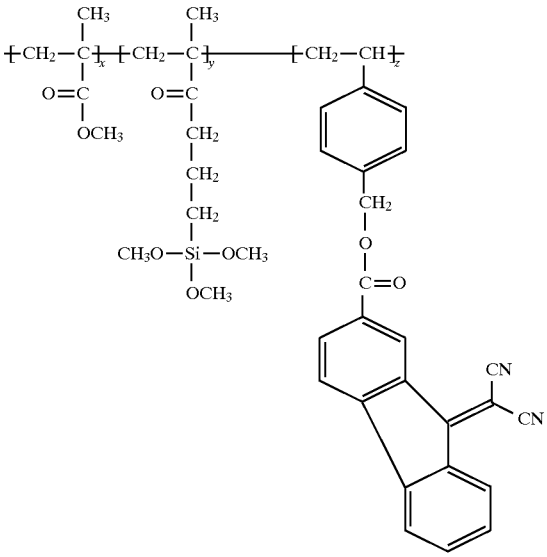
(III-e)
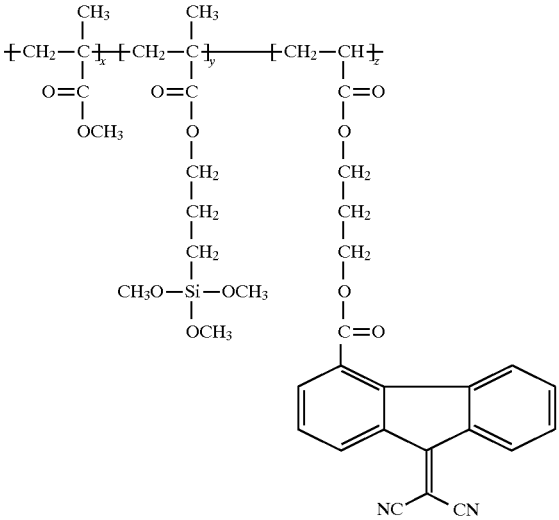

-continued (III-f)

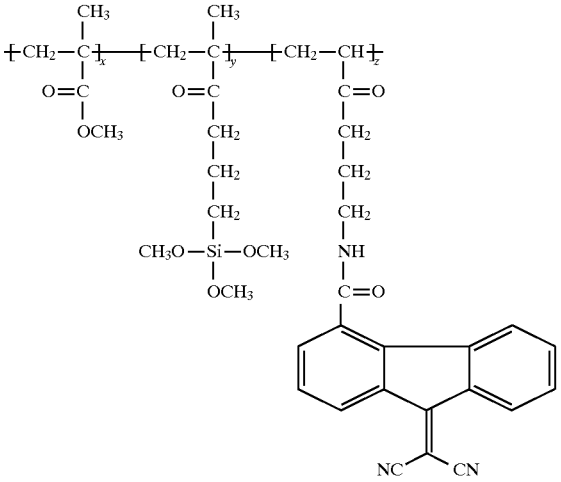

(III-g)

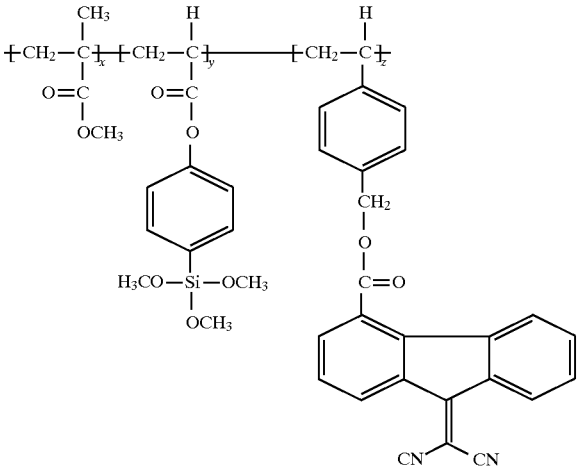

(III-h)

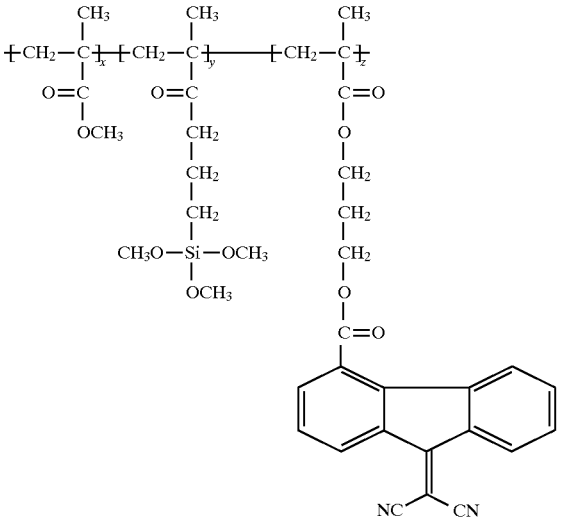

The hole blocking layer may be formed by coating a solution of polymer (III) in a suitable solvent on a substrate, followed by curing at an elevated temperature ranging from 80° C. to 200° C. to form a mechanically strong hole blocking layer with a thickness ranging from, for example, about 0.01 to about 10 microns, and preferably from about 0.1 to about 5 microns. Subsequently, a charge generator layer and a hole transport layer are formed on top of the said blocking layer to provide the photoresponsive imaging members of the present invention. The fabrication of the hole blocking layer derived from polymer (III) of the present invention can accomplished by many known coating techniques such as spray, dip or wirebar draw down methods. The coating for the blocking layers can comprise, for example, from about 3 weight percent to about 20 weight percent of the polymer (III) in a suitable solvent. Illustrative examples of solvents that can be selected for use as the coating solvent include aromatic hydrocarbons, halogenated aliphatic hydrocarbons, ethers, ketones, esters, amides, and the like. Specific examples are toluene, xylene, chlorobenzene, methylene chloride, trichloroethylene, tetrahydrofuran, dioxane, acetone, methyl ethyl ketone, cyclohexanone, butyl acetate, ethyl acetate, methoxyethyl acetate, dimethyl formamide, dimethyl acetamide, mixtures thereof, and the like.

The curing or crosslinking processes for the preparation of the hole blocking layer of the present invention can be accomplished at, for example, about 40° C. to about 200° C., preferably from about 80° C. to about 150° C. for about 30 minutes to about 2 hours. The crosslinking processes, as illustrated in scheme 2, involves the hydrolysis of the alkoxysilyl groups of polymer (III) to the hydroxysilyl groups, followed by subsequent condensation to form the siloxane (Si—O—Si) bonds. It is important that some water, for example, about 1 to about 15 weight percent is present in the coating solution to effect the hydrolysis of the alkoxysilyl groups. Traces of water that are present in the coating solvents may often be sufficient to induce the required hydrolysis reaction, or water may be added, particularly if the coating solvent is a water-mixable one such as tetrahydrofuran, methanol, ethanol, methyl ethyl ketone. Additionally, curing or crosslinking of the coated blocking layers may also occur by humidification via exposing to a moist atmosphere prior to or during thermal treatment to effect the crosslinking reactions.

Scheme 2

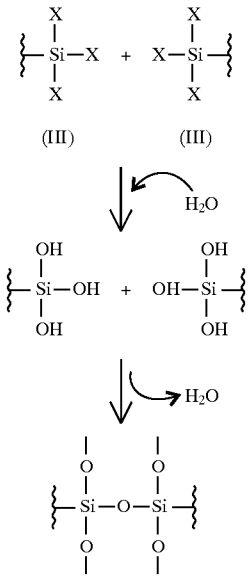

Preferably, the aforementioned coating compositions contain a crosslinking or curing catalyst such as an organic amine compound like trialkylamine or a carboxylic acid such as acetic acid to accelerate the curing. Specifically, the curing catalyst can be present in the coating compositions in an amount of, for example, from about 0.01 to about 10 weight percent of polymer (III) in the coating solution.

Schematically, the crosslinked siloxane hole blocking layer of the present invention can be represented by the following formula structure

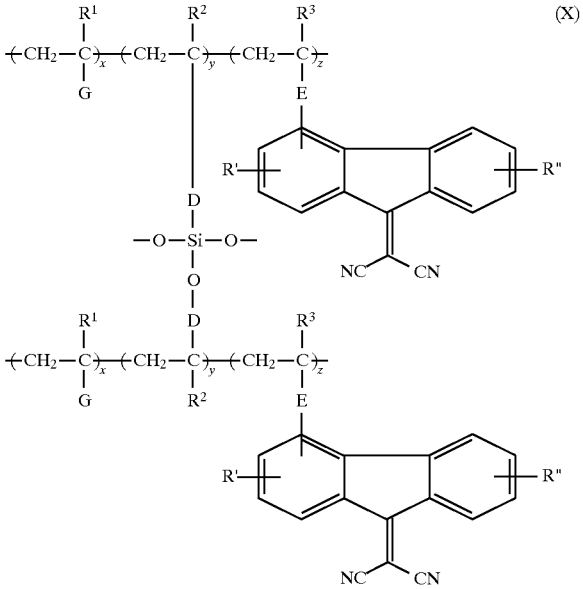

wherein the substituents are as illustrated herein, for example, wherein A, B. and C are the repeating units on the polymer backbone; D and E are divalent linkages; X is a hydrolyzable function; R' and R" are substituents preferably selected from the group consisting of hydrogen, fluorine, chlorine, bromine, iodine, cyano, nitro, alkyl, alkoxy, acyl, alkoxycarbonyl, aryloxycarbonyl, and the like; and x, y, and z are the molar fractions of the repeating monomer units such that x+y+z=1.

The hole blocking layer illustrated herein and prepared, for example, in accordance with the processes specified can be applied to the imaging members disclosed herein. Specifically, there is illustrated in FIG. 1 a photoresponsive imaging member of the present invention comprised of a supporting substrate 1, such as aluminum, on optional layer 2 of a thickness of from about 0.01 micron to 150 microns of, for example, a copper iodide, or a carbon black dispersion in a suitable binder such as poly(vinyl fluoride), polyester, and the like; a hole blocking layer 3 of the present invention comprised of a crosslinked polymer layer derived from polymer (III) as illustrated herein, with a thickness of from about 0.001 micron to about 10 microns, and preferably 0.01 to about 5 microns; an optional adhesive layer 4 of a thickness of from about 0.001 micron to 0.5 micron; a photogenerator layer 5 of a thickness of 0.1 micron to 2 microns; and a charge transport layer 6 of a thickness of from about 5 microns to 50 microns comprised of an amine hole transporting compound such as N,N'-diphenyl-N,N'-bis(3-methylphenyl)-1,1-biphenyl-4,4'-diamine, dispersed in a polymer binder.

Figure 2:
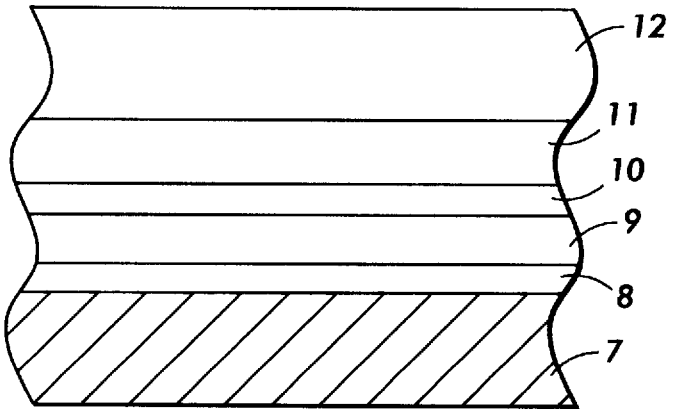

In another embodiment, there is illustrated in FIG. 2 a photoresponsive imaging member of the present invention comprised of a polymeric supporting substrate 7, such as a MYLAR®, coated thereover a conductive layer 8 of, for example, aluminum or titanium; a hole blocking is layer 9 comprised of a crosslinked polymer derived from polymer (III) of the present invention as illustrated herein; an optionally adhesive layer 10; a charge photogenerating layer 11 comprised of, for example, a hydroxygallium phthalocyanine Type V dispersed in 50 weight percent in a suitable binder system of for example polystyrene/polyvinylpyridine; and a charge transporting layer 12 comprised of a diamine hole transport compound such as N,N'-diphenyl-N,N'-bis(3-methylphenyl)-1,1-biphenyl-4,4'-diamine, in a polymer binder of for example a polycarbonate.

Examples of the substrate layer selected for the imaging members of the present invention can be opaque or substantially transparent, and may comprise any suitable materials having the requisite mechanical properties. Thus, the substrate may be comprised of an insulating material including inorganic or organic polymeric materials, such as MYLAR® a commercially available polymer, MYLAR® containing titanium, a layer 8 of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no adverse effects on the system. In an embodiment, the thickness of this layer is from about 75 microns to about 300 microns.

The photogenerating layer can contain known photogenerating components, such as pigments like metal phthalocyanines, metal free phthalocyanines, hydroxygallium phthalocyanines, perylenes, titanyl phthalocyanines, and the like, and more specifically vanadyl phthalocyanines, Type V hydroxygallium phthalocyanine, and inorganic materials such as selenium, especially trigonal selenium. The photogenerating pigment can be dispersed in a resin binder, or alternatively no resin binder is present. Generally, the thickness of the photogenerator layer depends on a number of factors, including the thickness of the other layers and the amount of photogenerator material contained in the photogenerating layer. Accordingly, the photogenerating layer can be of a thickness of, for example, from about 0.01 micron to about 10 microns, and more specifically, from about 0.25 micron to about 1 micron when, for example, the photogenerator material is present in an amount of from about 10 to about 100 percent by weight. The photogenerating layer binder resin, present in various suitable amounts, for example from about 0 to about 90 weight percent, and more specifically from about 1 to about 50 weight percent, may be selected from a number of known polymers such as poly(vinyl butyral), poly(vinyl carbazole), polystyrene-b-polyvinylpyridine, polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layer in embodiments of the present invention can be accomplished with spray, dip or wire-bar methods such that the final dry thickness of the photogenerator layer is, for example, from about 0.01 to about 30 microns and preferably from about 0.1 to about 10 microns after being dried at, for example, about 40° C. to about 150° C. for about 30 to about 90 minutes.

Illustrative examples of polymeric binder materials that can be selected for the photogenerator layers are as indicated herein, and include those polymers as disclosed in U.S. Pat. No. 3,121,006, the disclosure of which is totally incorporated herein by reference.

As an optional adhesive layer usually in contact with the hole blocking layer, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain in effective amounts, for example of from about 1 to about 20 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the charge transporting layer, which generally is of a thickness of from about 5 microns to about 75 microns, and preferably of a thickness of from about 10 microns to about 40 microns, include various suitable amines, such as amine molecules of the following formula:

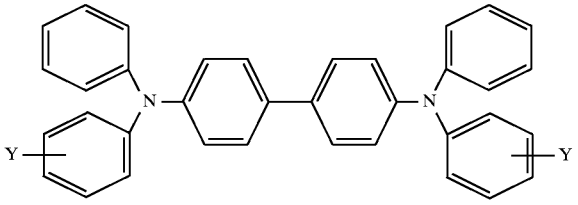

dispersed in a highly insulating and transparent polymer binder, wherein Y is for example, an alkyl group, an alkoxy group, a halogen atom, or mixtures thereof, especially those substituents selected from the group consisting of chlorine atom and methyl group.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4-diamine wherein the halogen substituents are preferably chlorine substituents. Other known charge transport layer molecules can be selected, reference for example U.S. Pat. Nos. 4,921,773 and 4,464,450, the disclosures of which are totally incorporated herein by reference, and the like.

Examples of the highly insulating and transparent polymer binder material for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 30 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples are also provided.

EXAMPLE I

Synthesis of Polymer (III-a with x=0.94, y=0.01, and z=0.05):

To a 1 liter round bottomed flask were added 60.0 grams of 9-dicyanomethylenefluorene-4-carboxylic acid, 700 milliliters of N,N-dimethylformamide, 67.1 grams of 4-vinylbenzyl chloride, and 37.0 grams of sodium bicarbonate, and the resulting mixture was stirred at 40° C. for 48 hours. The mixture was poured into 1,500 milliliters of distilled water with vigorous stirring, and the resulting aqueous mixture was extracted with 1,000 milliliters of dichloromethane. The organic layer was separated and was further washed with 1,500 milliliters of distilled water and dried over anhydrous magnesium sulfate. Subsequently, the organic solvent was removed by means of a rotary evaporator and the residue was recrystallized from a mixture of dichloromethane and methanol (2:1 by volume) to give vinylbenzyl 9-dicyanomethylenefluorene-4-carboxylate after filtration and drying in a vacuo for 48 hours.

$^1$H-NMR ($CDCl_3$): δ5.30 (d, J=10.5 Hz, 1H), 5.43 (s, 2H), 5.79 (d, J=17.5 Hz, 1H), 6.73 (d, J=10.5 Hz, 2H), 7.31–7.48 (m, overlapping with a singlet at 7.45, 7H), 7.88 (d, J=7.9 Hz, 1H), 8.07 (d, 7.9 Hz, 1H), 8.45 (d, J=7.8 Hz, 1H), 8.59 (d, J=7.9 Hz, 1H).

IR (KBr): 2224 (CN), 1735 (C═O) $cm^{-1}$.

To a 1 liter three-neck round-bottomed flask, under a nitrogen blanket, were added 7.90 gram of vinylbenzyl 9-dicyanomethylene fluorene-4-carboxylate as obtained above, 42.77 grams of methyl methacrylate, 1.12 grams of 3-(trimethoxysilyl) propyl methacrylate, and 400 milliliters of toluene. The resulting mixture was stirred at about 50° C. for 10 minutes, followed by the addition of 0.427 gram of benzoyl peroxide initiator. The mixture was subsequently stirred at 90° C. for 24 hours. The resulting polymer solution was diluted with 1,100 milliliters of toluene at room temperature, about 25° C. throughout, and was then poured into 6,000 milliliters of hexane with stirring to precipitate the polymer product. The solid product was collected by filtration and dried at room temperature in vacuo for 24 hours to give 44.21 grams (85.4 percent) of polymer (III-a). This precursor polymer possessed an $M_w$ of 59463 and $M_n$ of 24,389 as measured by GPC and IR (film) absorption of 2,223 (CN) and 1,736 (C═O) $cm^{-1}$.

EXAMPLE II

Synthesis of Polymer (III-a with x=0.88, v=0.07, and z=0.05):

The above polymer was prepared in accordance with the procedure of Example I except that 4.01 grams of vinylbenzyl 9-dicyanomethylene fluorene-4-carboxylate, 20.16 grams of methyl methacrylate, 4.00 grams of 3-(trimethoxysilyl) propyl methacrylate, and 80 ml of toluene were utilized. The yield was 25.0 grams (88.7 percent).

The polymer displayed an $M_w$ of 132,914 and $M_n$ of 41,367 as measured by GPC and IR (film) absorption of 2,220 (CN) and 1,736 (C═O) $cm^{-1}$.

EXAMPLE III

An illustrative photoresponsive imaging device of the present invention was fabricated as follows.

On a 75 micron thick titanized MYLAR® substrate was coated by draw bar technique a hole blocking layer from a solution of 2.0 grams of polymer (III-a) of Example I in 20 milliliters of toluene. After drying at 120° C. for 30 minutes, a crosslinked hole blocking layer (HBL) of a thickness of about 1.0 micron was obtained. Overcoated on the top of the blocking layer was a 0.05 micron thick adhesive layer prepared from a solution of 2 weight percent of a DuPont 49K polyester in dichloromethane. A 0.2 micron photogenerating layer was subsequently coated on top of the adhesive layer from a dispersion of hydroxy gallium phthalocyanine Type V (0.46 gram) and a polystyrene-b-polyvinylpyridine block copolymer (0.48 gram) in 20 grams of toluene, followed by drying at 100° C. for 10 minutes. The device fabrication was completed by coating on the photogenerating layer prepared above, a 25 microns charge transporting layer (CTL) from a solution of N,N'-diphenyl-N,N-bis(3-methyl phenyl)-1,1'-biphenyl-4,4'-diamine (2.64 grams) and a polycarbonate (3.5 grams) in 40 grams of dichloromethane.

A control device was also prepared in a similar manner without a hole blocking layer.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

The following table summarizes the electrical performance of these devices, and indicates the effective blockage of charge injection by the hole blocking layer (HBL) of the present invention. Specifically, while the dark development potential ($V_{ddp}$), the half discharge exposure energy ($E_{1/2}$), and the residual voltage (Vr) are similar for the control device without a hole blocking layer and the device with the crosslinked siloxane hole blocking layer of the present invention, the dark decay, which measures the dark conductivity related to hole injection into the photogenerator layer, of the device of the present invention is significantly lower than that of the control device (the dark decay is much lower with a blocking layer, while other properties such as $V_{ddp}$, $E_{1/2}$, and residual (Vr) are similar).

| Device | CTL (μm) | Vddp (V) | $E_{1/2}$ ergs/cm$^2$ | Dark Decay (V@ 500 ms) | Vr (V) |
|---|---|---|---|---|---|
| Control Device without HBL | 25.4 | 813 | 1.54 | 19.6 | 0–4 |
| Device with 1 μm Crosslinked Siloxane HBL | 24.1 | 797 | 1.57 | 9.6 | 0–6 |

CTL = charge transport
Vr = residual voltage

EXAMPLE IV

A photoresponsive imaging device with a hole blocking layer derived from polymer III-a of Example II was prepared in accordance to procedure of Example III. The HBL thickness was about 1.0 micron. The following table summarizes the electrical performance of this device:

| Device | CTL (μm) | Vddp (V) | $E_{1/2}$ ergs/cm$^2$ | Dark Decay (V@ 500 ms) | Vr (V) |
|---|---|---|---|---|---|
| Control Device without HBL | 25.4 | 813 | 1.54 | 19.6 | 0–4 |
| Device with 1 μm Crosslinked Siloxane HBL | 26.0 | 832 | 1.58 | 9.2 | 0–5 |

EXAMPLE V

Another photoresponsive imaging device with a hole blocking layer of the present invention was fabricated in accordance to the procedure of Example IV except that the HBL thickness was about 2.0 microns instead of 1.0 micron. The following table summarizes the electrical performance of this device:

| Device | CTL (μm) | Vddp (V) | $E_{1/2}$ ergs/cm$^2$ | Dark Decay (V@ 500 ms) | Vr (V) |
|---|---|---|---|---|---|
| Control Device without HBL | 25.4 | 813 | 1.54 | 19.6 | 0–4 |
| Device with 2 μm Crosslinked Siloxane HBL | 26.4 | 808 | 1.46 | 12.7 | 0–2 |

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer thereover, a photogenerating layer and a charge transport layer, and wherein the hole blocking layer is comprised of a crosslinked siloxane polymer schematically represented by

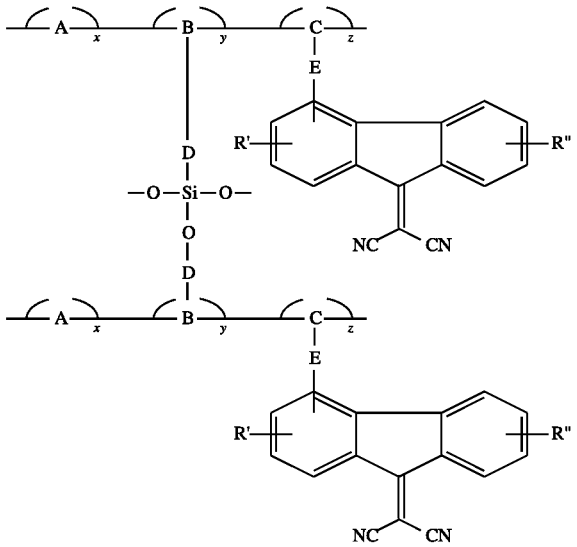

wherein A, B, and C are the repeating units on the polymer backbone; D and E are divalent linkage components wherein D is selected from the group consisting of alkylene, arylene, alkyleneoxycarbonyl and aryleneoxycarbonyl and E is selected from the group consisting of arylene, alkylenearyl, alkyleneoxycarbonyl, aryleneoxycarbonyl, carbonyloxyalkyleneoxycarbonyl, carbonyloxyaryleneoxycarbonyl, carbonyloxyalkylenearyl, carbonyloxyaryl, carbonyloxyalkylene aminocarbonyl and carbonyloxyarylene aminocarbonyl; R' and R" are selected from the group consisting of hydrogen, fluorine, chlorine, bromine, iodine, cyano, nitro, alkyl, alkoxy, acyl, alkoxycarbonyl, and aryloxycarbonyl; and x, y, and z are the molar fractions of the repeating monomer units such that the sum of x+y+z equal to about 1.

2. A photoconductive imaging member in accordance with claim 1 wherein D is trimethyleneoxycarbonyl, phenyleneoxycarbonyl, or methylenearyloxycarbonyl; E is carbonyloxyalkeneoxycarbonyl, carbonyloxyaryleneoxycarbonyl, carbonyloxyalkylenearyl, or carbonyloxyaryl.

3. A photoconductive imaging member in accordance with claim 1 wherein A is derived from a vinyl monomer selected from the group consisting of styrene, substituted styrene, acrylonitrile, 1,3-diene, vinyl halide, acrylate, or methacrylate.

4. A photoconductive imaging member in accordance with claim 3 wherein acrylate is selected from the group consisting of methyl acrylate, ethyl acrylate, propyl acrylate, and butyl acrylate; and methacrylate is selected from the group consisting of methyl methacrylate, ethyl methacrylate, propyl methacrylate, and butyl methacrylate.

5. A photoconductive imaging member in accordance with claim 1 wherein x ranges from about 0 (zero) to about 0.95, y ranges from about 0.01 to about 0.50, and z ranges from about 0.01 to about 0.50.

6. A photoconductive imaging member comprised of a supporting substrate, a hole blocking layer thereover, a photogenerating layer and a charge transport layer, and wherein the hole blocking layer is comprised of a crosslinked siloxane polymer derived from the hydrolysis and condensation of polymer (III)

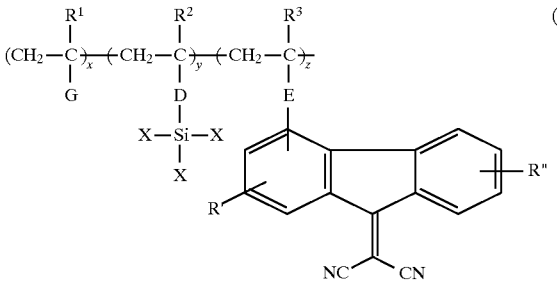

(III)

wherein $R^1$, $R^2$, and $R^3$ are hydrogen atoms or alkyl groups; G is chlorine, cyano, aryl, alkoxycarbonyl, or aryloxycarbonyl; D is selected from the group consisting of arylene, alkylenearyl, alkyleneoxyaryl, alkyleneoxycarbonyl, and aryleneoxycarbonyl; E is selected from the group consisting of arylene, alkylenearyl, alkyleneoxycarbonyl, aryleneoxycarbonyl, carbonyloxy alkeneoxycarbonyl, carbonyloxyaryleneoxycarbonyl, carbonyloxy alkylenearyl, carbonyloxyaryl, carbonyloxyalkyleneamino carbonyl, and carbonyoxylarylene aminocarbonyl; X is a hydrolyzable function selected from the group consisting of chlorine, bromine, iodine, amino, alkoxy and acyloxy, and aryloxy; R' and R" are substituents selected from the group consisting of hydrogen, fluorine, chlorine, bromine, iodine, cyano, nitro, alkyl, alkoxy, acyl, alkoxycarbonyl, and aryloxycarbonyl; x, y, and z are the molar fractions of the repeating monomer units such that x+y+z is equal to about 1.

7. A photoconductive imaging member in accordance with claim 6 wherein D is alkyleneoxycarbonyl or aryleneoxycarbonyl; E is carbonyloxyalkeneoxycarbonyl, carbonyloxyaryleneoxycarbonyl, carbonyloxyaryl, or carbonyloxyalkylenearyl; X is alkoxy containing from about 1 to about 6 carbon atoms; G is alkoxycarbonyl, chlorine, or cyano; and R' and R" are independently selected from hydrogen and alkyl containing from about 1 to about 10 carbon atoms.

8. A photoconductive imaging member in accordance with claim 6 wherein x ranges from about 0 to about 0.95, y ranges from about 0.01 to about 0.50, and z ranges from about 0.01 to about 0.50.

9. A photoconductive imaging member in accordance with claim 6 wherein $R^1$, $R^2$, and $R^3$ are hydrogen atoms or methyl groups.

10. A photoconductive imaging member in accordance with claim 6 wherein E is selected from the group consisting of formulas (IV) through (VI)

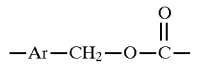

(IV)

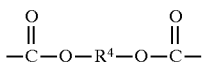

(V)

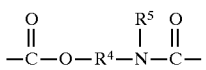

(VI)

wherein Ar is arylene containing from about 6 to about 12 carbon atoms; $R^4$ is alkylene containing from about 1 to about 10 carbon atoms, or arylene containing from about 6 to about 12 carbon atoms, and $R^5$ is hydrogen or alkyl containing from about 1 to about 3 carbon atoms.

11. A photoconductive imaging member in accordance with claim 6 wherein polymer (III) has an $M_n$ of about 2,000 to about 50,000.

12. A photoconductive imaging member in accordance with claim 6 wherein polymer (III) is selected from the group consisting of Formulas (II-a) through (III-h).

13. A photoconductive imaging member in accordance with claim 12 wherein (III-a), (III-b), or (III-c) is selected.

14. A photoconductive imaging member in accordance with claim 1 wherein the thickness of the hole blocking layer ranges from about 0.01 to about 5 microns.

15. A photoconductive imaging member in accordance with claim 1 wherein the supporting substrate is comprised of a metal.

16. A photoconductive imaging member in accordance with claim 1 wherein the conductive substrate is aluminum, aluminized MYLAR®, or titanized MYLAR®.

17. A photoconductive imaging member in accordance with claim 1 wherein the photogenerator layer is of a thickness of from about 0.05 to about 5 microns.

18. A photoconductive imaging member in accordance with claim 1 wherein the transport layer is of a thickness of from about 10 to about 50 microns.

19. A photoconductive imaging member in accordance with claim 1 wherein the photogenerating layer is comprised of photogenerating pigments dispersed in a resinous binder, and which pigments are present in an amount of from about 5 percent by weight to about 95 percent by weight.

20. A photoconductive imaging member in accordance with claim 19 wherein the resinous binder is selected from the group consisting of polyesters, polyvinyl butyrals, polycarbonates, polystyrene-b-polyvinyl pyridine, and polyvinyl formals.

21. A photoconductive imaging member in accordance with claim 1 wherein the charge transport layer is comprised of an arylamine dispersed in a resinous binder.

22. A photoconductive imaging member in accordance with claim 21 wherein the arylamine is represented by the following formula

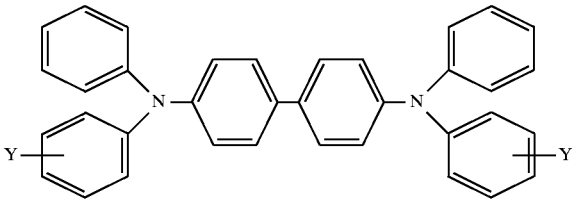

wherein Y is selected from the group consisting of alkyl and halogen atoms.

23. A photoconductive imaging member in accordance with claim 22 wherein alkyl contains from about 1 to about 25 carbon atoms.

24. A photoconductive imaging member in accordance with claim 22 wherein alkyl contains from 1 to about 5 carbon atoms.

25. A photoconductive imaging member in accordance with claim 22 wherein the arylamine is N,N'-diphenyl-N,N-bis(3-methyl phenyl)1,1'-biphenyl-4,4'-diamine.

26. A photoconductive imaging member in accordance with claim 1 further including an adhesive layer.

27. A photoconductive imaging member in accordance with claim 1 wherein the photogenerating layer is comprised of metal phthalocyanines, perylenes or metal free phthalocyanines.

28. A photoconductive imaging member in accordance with claim 27 wherein titanyl phthalocyanine, perylene, or hydroxygallium phthalocyanine is selected as the photogenerating pigment.

29. A photoconductive imaging member in accordance with claim 1 wherein the photogenerating layer is comprised of Type V hydroxygallium phthalocyanine dispersed in a polymer binder.

30. A method of imaging which comprises generating an electrostatic latent image on the imaging member of claim 1, developing the latent image, and transferring the developed electrostatic image to a suitable substrate.

31. A member in accordance with claim 1 wherein the crosslinked siloxane polymer is

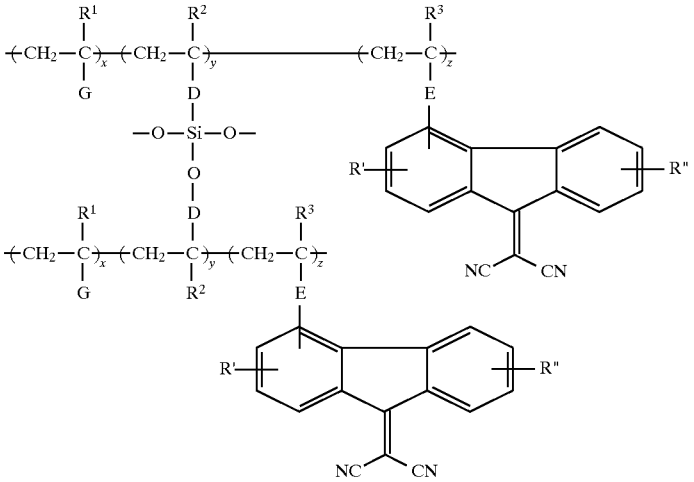

(X)

wherein $R^1$, $R^2$, and $R^3$ are hydrogen atoms or alkyl groups; G is chlorine, cyano, aryl, alkoxycarbonyl, or aryloxycarbonyl; D is a divalent linkage selected from the group consisting of arylene, alkylenearyl, alkyleneoxyaryl, alkyleneoxycarbonyl, and aryleneoxycarbonyl; E is a divalent linkage selected from the group consisting of arylene, alkylenearyl, alkyleneoxycarbonyl, aryleneoxycarbonyl, carbonyloxyalkeneoxycarbonyl, carbonyloxyaryleneoxycarbonyl, carbonyloxyalkylenearyl, carbonyloxyaryl, carbonyloxylalkyleneaminocarbonyl, and carbonyoxylarylene aminocarbonyl; R' and R" are substituents selected from the group consisting of hydrogen, fluorine, chlorine, bromine, iodine, cyano, nitro, alkyl, alkoxy, acyl, alkoxycarbonyl, or aryloxycarbonyl; x, y, and z are the molar fractions of the repeating monomer units such that x+y+z is equal to about 1.

32. A member in accordance with claim 1 wherein said crosslinked siloxane polymer is derived from the hydrolysis and condensation of polymer (II)

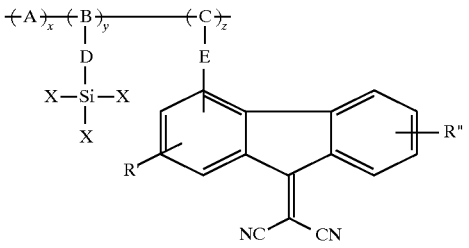

(II)

wherein X is a hydrolyzable function.

33. A member in accordance with claim 32 wherein said crosslinked siloxane is generated by the polymerization of

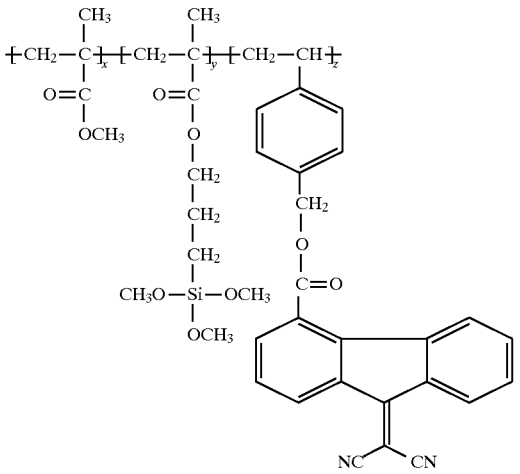

(III-a)

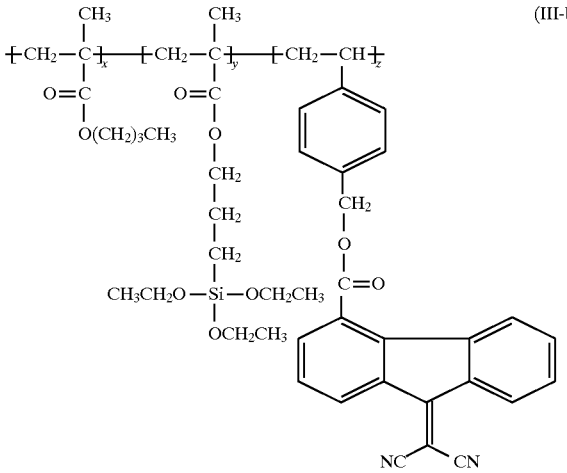

(III-b)

-continued
(III-c)
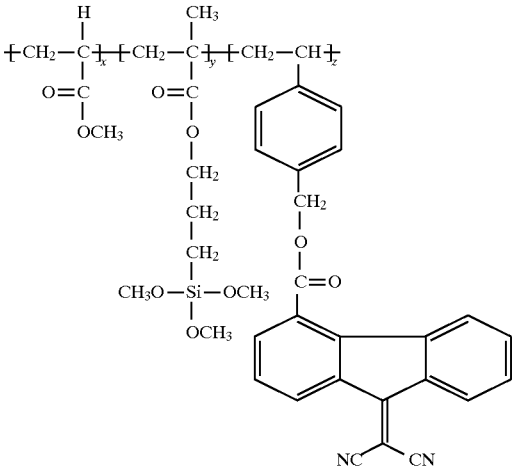
(III-d)
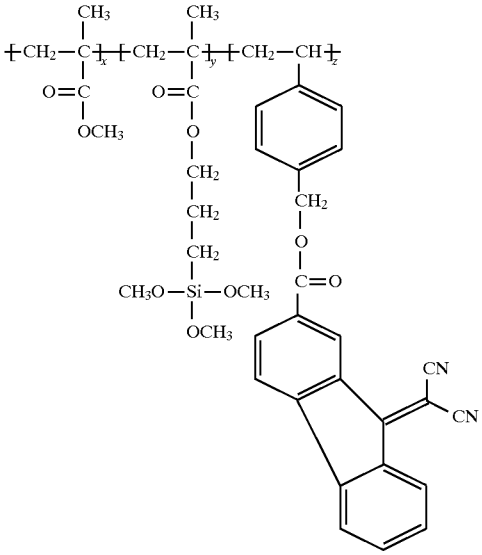
(III-e)
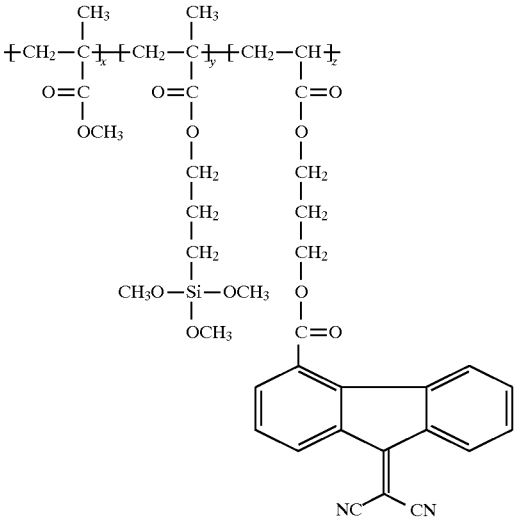
-continued
(III-f)
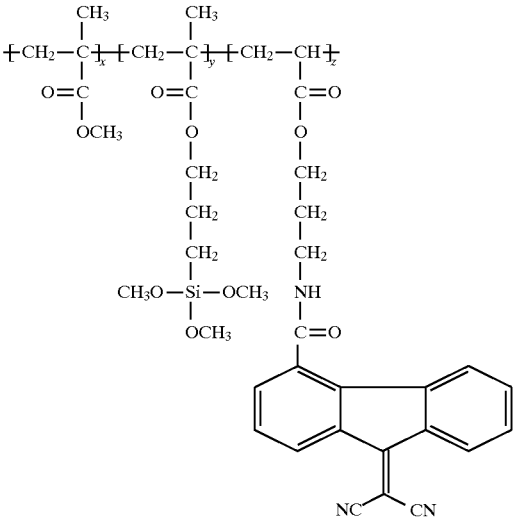
(III-g)
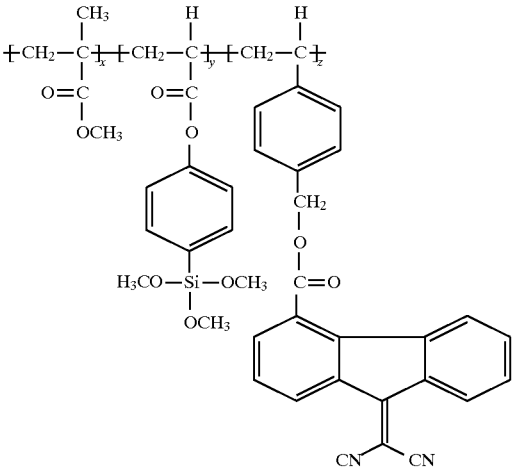
(III-h)
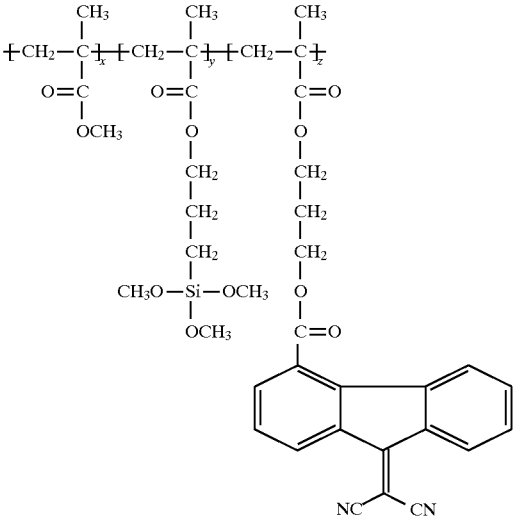

34. A photoconductive imaging member in accordance with claim 1 wherein x is a number of from about 0.5 to about 0.75, y is a number of from about 0.05 to about 0.25, and z is a number of from about 0.01 to about 0.50, subject to the provision that the sum of x+y+z is equal to about 1.

35. A photoconductive imaging member in accordance with claim 1 wherein x is a number of from about 0.3 to about 0.65, y is a number of from about 0.1 to about 0.50, and z is a number of from about 0.1 to about 0.50, and wherein the sum of x+y+z is equal to about 1.

* * * * *